US006685299B2

(12) United States Patent
Hirota

(10) Patent No.: US 6,685,299 B2
(45) Date of Patent: Feb. 3, 2004

(54) INK JET HEAD

(75) Inventor: Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/157,193

(22) Filed: May 30, 2002

(65) Prior Publication Data

US 2002/0180827 A1 Dec. 5, 2002

(30) Foreign Application Priority Data

May 31, 2001 (JP) ..... 2001-164664
May 31, 2001 (JP) ..... 2001-164665
May 31, 2001 (JP) ..... 2001-164666

(51) Int. Cl.[7] ..... B41J 8/015; B41J 2/045

(52) U.S. Cl. ..... 347/20; 347/68; 347/70; 347/71

(58) Field of Search ..... 347/68, 70, 71, 347/20, 69, 89, 92, 94

(56) References Cited

U.S. PATENT DOCUMENTS 5,087,930 A * 2/1992 Roy et al. ..... 347/85
5,402,159 A 3/1995 Takahashi et al. ..... 347/9
5,489,930 A * 2/1996 Anderson ..... 347/71
5,734,399 A 3/1998 Weber et al. ..... 347/65
6,152,559 A 11/2000 Kojima ..... 347/85

OTHER PUBLICATIONS

Burke et al., "Particle Tolerant Architecture", IS&T's NIP16: 2000 International Conference on Digital Printing Technologies, pp. 39–43.

* cited by examiner

*Primary Examiner*—Stephen D. Meier
*Assistant Examiner*—Alfred E. Dudding
(74) *Attorney, Agent, or Firm*—Oliff & Berridge, PLC

(57) ABSTRACT

An ink jet head includes rows of pressure chambers, a common ink chamber, and a circulation channel. Filter holes are provided along a fluid channel connecting the common ink chamber with the pressure chambers. The common ink chamber is formed broader at a region separated from, and with a weaker mechanical stiffness than, the portion that is connected to the pressure chambers. The common ink chamber and the circulation channel are elongated in the direction that the pressure chamber rows extend. The circulation channel and the common ink chamber are in fluid communication with each other at one lengthwise end and both have an opening at the opposite lengthwise end to enable connection to the external ink supply.

21 Claims, 4 Drawing Sheets

INK JET HEAD

BACKGROUND OF THE INVENTION

1. Field of the Invention

The present invention relates to an ink jet head.

2. Description of the Related Art

A typical ink jet head is formed with a plurality of pressure chambers in fluid communication with a common ink chamber. The common ink charter is supplied with ink from an ink tank and distributes the ink to the pressure chambers. Pressure is applied to ink in selected ones of the pressure chambers to eject ink droplets from nozzles orifices that are in fluid communication with the pressure chambers.

A pressure wave is generated when pressure is applied to ink in one of the pressure chamber. The pressure wave can propagate into the common ink chamber. The resultant pressure fluctuations in the common ink chamber can adversely influence subsequent ink ejections, resulting in poor recording quality.

Ink jet printers are typically provided with a recovery unit. The recovery unit is used to remove dust or other material that might or does clog up channels or nozzle orifices. By providing and using the recovery unit, the ejection characteristics of the ink jet head can be maintain at a stable condition, or the ink jet head's ejection characteristics can be recovered when the ink jet head starts ejecting ink in a defective manner.

One type of recovery unit includes a cap connected to a suction pump. When the recovery unit is operated, the cap covers the nozzle plate of the ink jet head and the suction pump generates a negative pressure within the cap. As a result, ink is sucked from the ink jet head through the cap. Bubbles generated in the ink jet head and ink that has started to dry up in the nozzle orifices are sucked out from the ink jet head along with the ink. However, this configuration has a disadvantage in that all of the ink in the common ink chamber and a portion of the ink in the ink tank are sucked into the cap, so that a relatively large amount of ink is consumed.

Another type of recovery unit is configured by connecting the ink tank to both opposite ends of the common ink chamber by tubes. Ink is forced through one of the tubes from the ink tank to the common ink chamber and through the other tube from the common ink chamber to the ink tank. This circulation operation removes bubbles from inside the common ink chamber and the tubes. This configuration uses up less ink than a recovery unit that sucks ink from the ink jet head into a cap. However, because the two tubes must be connected to either end of the common ink chamber, the structure of the ink jet head is complicated and also bulky.

A filter is typically provided where the common ink chamber is connected to the ink tank. The filter prevents dust and other debris from entering the pressure chambers and the nozzle orifices from the ink tank. However, sometimes debris can enter the ink jet head while the ink jet head is being manufactured. Such debris cannot be removed by the filter and so can clog up the pressure chambers and the nozzle orifices.

SUMMARY OF THE INVENTION

In order to absorb any pressure fluctuations in the common ink chamber, it is conceivable to form the portion of the common ink chamber where the common ink chamber is connected to the pressure chambers from a soft film, made from rubber, resin, or other soft material. However, it would be difficult to manufacture an ink jet head with a soft film mounted on a portion of the ink jet head. Additionally, portions of the pressure chamber row that are adjacent to the film have a different mechanical stiffness than do other portions of the pressure chamber row. When the mechanical stiffness of the pressure chambers lacks uniformity, pressure generated in the pressure chambers can also vary so that ink ejection also lacks uniformity It is an objective of the present invention to provide a simple configuration that effectively absorbs pressure fluctuations associated with ink ejection so that cross talk can be prevented, uniform ink ejection from all of the pressure chambers can be assured, and high-quality images can be formed.

It is another objective of the present invention to provide a compact and simple configuration that enables stably maintaining and recovering good ejection characteristics of an ink jet head without unnecessarily wasting a great amount of ink.

It is still another objective of the present invention to overcome the above-described problems and to provide an ink jet head with a simple structure that reduces the amount of clogging in pressure chambers and nozzle orifices caused by dust and other debris that entered the ink jet head during production of the ink jet head.

To achieve the above-described objectives, an ink jet head according to a first aspect of the present invention includes a pressure chamber portion and a common ink chamber portion. The pressure chamber portion is formed with a row of pressure chambers aligned in a pressure chamber row direction. Each pressure chamber has a nozzle end and a common-ink-chamber end at opposite ends thereof. The nozzle end of each pressure chamber is in fluid communication with a corresponding nozzle orifice. The common ink chamber portion is formed with a common ink chamber elongated in the pressure chamber row direction. The common ink chamber includes a pressure-chamber region and a weak-mechanical-stiffness region that are separated from each other. The pressure-chamber region is in fluid communication with the common-ink-chamber end of each pressure chamber so that ink is supplied from the common ink chamber to the pressure chambers. The weak-mechanical-stiffness region has a weaker mechanical stiffness than mechanical stiffness at the pressure-chamber region. According to the present invention, mechanical stiffness is expressed using the following equation:

$$\text{mechanical stiffness}=dV/P$$

wherein P is the pressure applied in the common ink chamber; and dV is the resultant fluctuation in volume in the common ink chamber. It can be understood that a larger value of mechanical stiffness actually represents a weaker mechanical stiffness.

With this configuration, pressure fluctuations are absorbed by the region with weak mechanical stiffness. Also, all the pressure chamber have uniform mechanical stiffness so that pressure generated in the pressure chambers is uniform and good-quality recording can be realized.

According to a second aspect of the present invention, an ink jet head includes a pressure chamber portion and a common ink chamber portion. The pressure chamber portion is formed with a row of pressure chambers aligned in a pressure chamber row direction. Each pressure chamber has a nozzle end and a common-ink-chamber end at opposite ends thereof. The nozzle end of each pressure chamber is in fluid communication with a corresponding nozzle orifice. The common ink chamber portion is formed with a common ink chamber elongated in the pressure chamber row direction. The common ink chamber includes a pressure-chamber region, an ink-supply-connection opening, and a broad-width region. The pressure-chamber region is located where the common ink chamber is in fluid communication with the common-ink-chamber end of each pressure chamber, so that ink is supplied from the common ink chamber to the pressure chambers. The ink-supply-connection opening is in fluid communication with an external ink supply source. The broad-width region is located at an opposite lengthwise end of the common ink chamber than the ink-supply-connection opening. The broad-width region is separated from the pressure-chamber region and has a broader width than other regions of the common ink chamber.

Pressure waves are generated when the pressure chambers operate to eject ink. The pressure waves can propagate into the common ink chamber in association with ink flow. With the configuration of the second aspect of the present invention, pressure waves that propagate into common ink chamber are dampened by the broad-width region. Therefore, pressure fluctuations in the common ink chamber can be reduced and ink ejection characteristics can be stabilized.

An ink jet head according to a third aspect of the present invention includes a pressure chamber portion, a common ink chamber portion, and a circulation channel portion. The pressure chamber portion is formed with a row of pressure chambers aligned in a pressure chamber row direction. Each pressure chamber has a nozzle end and a common-ink-chamber end at opposite ends thereof. The nozzle end of each pressure chamber is in fluid communication with a corresponding nozzle orifice. The common ink chamber portion is formed with a common ink chamber elongated in the pressure chamber row direction. The common ink chamber is in fluid communication with the common-ink-chamber end of each pressure chamber so that ink is supplied from the common ink chamber to the pressure chambers. The common ink chamber includes an ink-supply-connection opening at one lengthwise end thereof to enable connection to an external ink supply. The circulation channel portion is formed with a circulation channel that extends substantially parallel with the common ink channel. The circulation channel includes an ink-supply-connection opening at one lengthwise end thereof to enable connection to the external ink supply. The circulation channel and the common ink chamber are in fluid communication with each other at a lengthwise end opposite from the lengthwise end formed with the ink-supply-connection openings of the circulation channel and the common ink chamber.

With this configuration, ink can be supplied into the ink-supply-connection opening of one of the circulation channel and the common ink chamber and discharged through the ink-supply-connection opening of the other one of the circulation channel and the common ink chamber. As a result, air bubbles in the ink can be returned to the ink supply source along with the ink, so that ink supplied from the common ink chamber to the pressure chambers has less air bubbles. Accordingly, a compact and simple configuration that enables stably maintaining and recovering good ejection characteristics of an ink jet head without unnecessarily wasting a great amount of ink can be made.

The ink jet head according to any of the first to third aspects of the present invention can be provided to a ink jet recording device with a circulation unit. The circulation unit is in fluid communication with the ink-supply-connection opening of the common ink chamber and with the ink-supply-connection opening of the circulation channel. The circulation unit forces ink from the ink supply source into one of the ink-supply-connection openings and returns ink to the ink supply source from the other one of the ink-supply-connection openings.

An ink jet head according to a fourth aspect of the present invention includes a first substrate, a second substrate, and a third substrate stacked on top of each other. The first substrate is formed with a plurality of pressure chambers aligned in a pressure chamber row direction. Each pressure chamber has a nozzle end and a common-ink-chamber end at opposite ends thereof. The nozzle end of each pressure chamber is in fluid communication with a corresponding nozzle orifice. The second substrate is formed with a common ink chamber elongated in the pressure chamber row direction. The common ink chamber is in fluid communication with the common-ink-chamber end of each pressure chamber so that ink is supplied from the common ink chamber to the pressure chambers. The third substrate is interposed between the first substrate and the second substrate. The third substrate includes a plurality of filter holes located where the common ink chamber is in fluid communication with the common-ink-chamber end of each pressure chamber.

With this configuration, because the filter holes are interposed between the pressure chambers and the common ink chamber, dust and other debris that entered the ink jet head during manufacture of the ink jet head is less likely to flow from the common ink chamber into the pressure chambers and accumulate in the channel between the common ink chamber and the pressure chamber. Accordingly, clogs in the pressure chambers and the nozzle orifices can also be prevented. Also, the filters can be easily provided to all of the pressure chambers by sandwiching the third substrate, which is formed with the filter holes, between the first substrate, which is formed with the pressure chambers, and the second substrate, which is formed with the common ink chamber.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Figure 1:
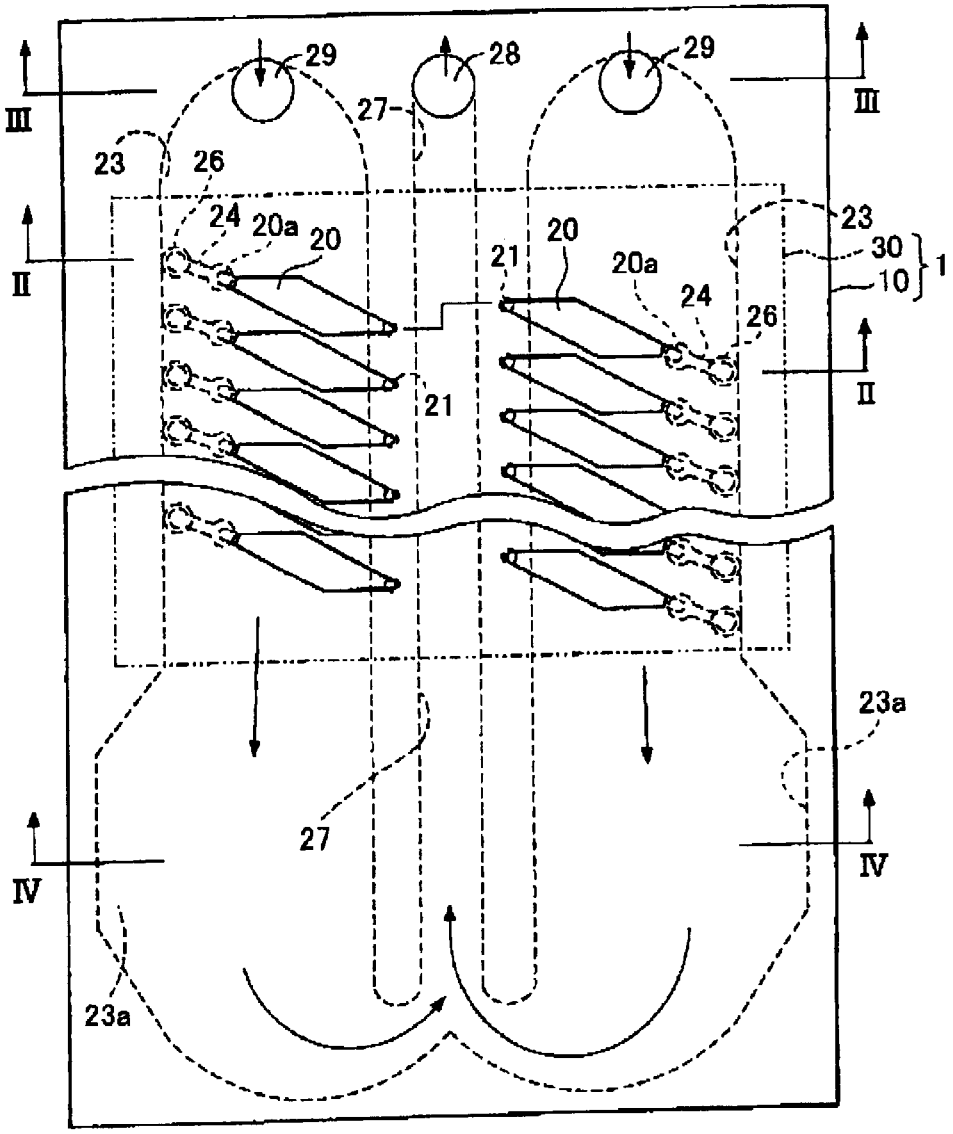
FIG. 1 is a plan view partially in phantom showing an ink jet print head according to an embodiment of the present invention.

Next, an ink jet head 1 according to an embodiment of the present invention will be described with reference to the attached drawings. As shown in FIG. 1, the ink jet head 1 includes a cavity plate set 10 and an actuator unit actuator 30 stacked on top of each other.

Figure 2:
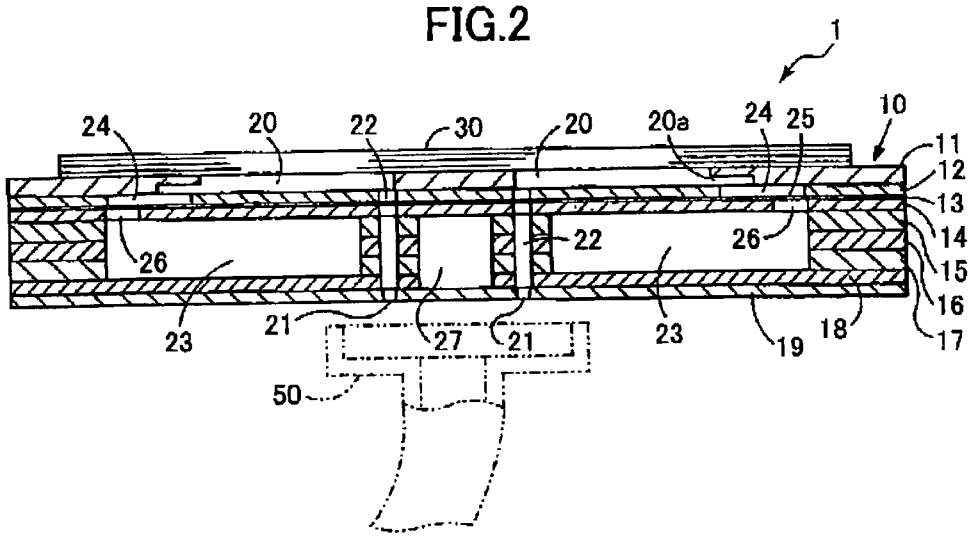
FIG. 2 is a cross-sectional view taken along line II—II of FIG. 1.

The cavity plate set 10 is Formed with a plurality of pressure chambers 20, two common ink chambers 23, 23, nozzle orifices 21, a circulation channel 27, and various other ink channels for bringing these into fluid communication with each other. As shown in FIG. 2, the cavity plate set 10 is configured from first through ninth substrates 11 to 19 adhered to each other in a laminated stack, with the first substrate 11 at the top of the stack and the ninth substrate 19 at the bottom of the stack. Each of the substrates 11 to 19 is formed with openings using etching. When the substrates 11 to 19 are stacked together to form the cavity plate set 10, the openings in the substrates configure the pressure chambers 20, the nozzle orifices 21, the circulation channel 27, and the various other ink channels.

The pressure chambers 20 are formed in the uppermost substrate 11 in a region beneath the actuator 30. As shown in FIG. 1, the pressure chambers 20 are aligned in two rows. The rows of pressure chambers 20 define an imaginary plane that extends horizontally above and substantially in parallel with an imaginary plane defined by the corresponding one of the common ink chambers 23, 23. Each pressure chamber 20 is oriented with one end nearer the outside of the cavity plate 10 and the other end nearer the center side of the cavity plate 10. As shown in FIG. 2, the center-side end of each of the pressure chambers 20 is positioned in confrontation with the corresponding nozzle orifice 21. The nozzle orifices 21 are formed in the lowermost substrate 19. Through holes 22 that bring the center-side ends of the pressure chambers 20 into fluid communication with the corresponding nozzle orifices 21 are formed by openings in the substrates 12 to 18, which are interposed between the uppermost substrate 11 and the lowermost substrate 19. The outer end of each of the pressure chambers 20 is in fluid communication with a corresponding through hole 26. As can be seen in FIG. 1, the through holes 26 are aligned following an outer lengthwise edge of the corresponding one of the common ink chambers 23, 23.

Figure 3:
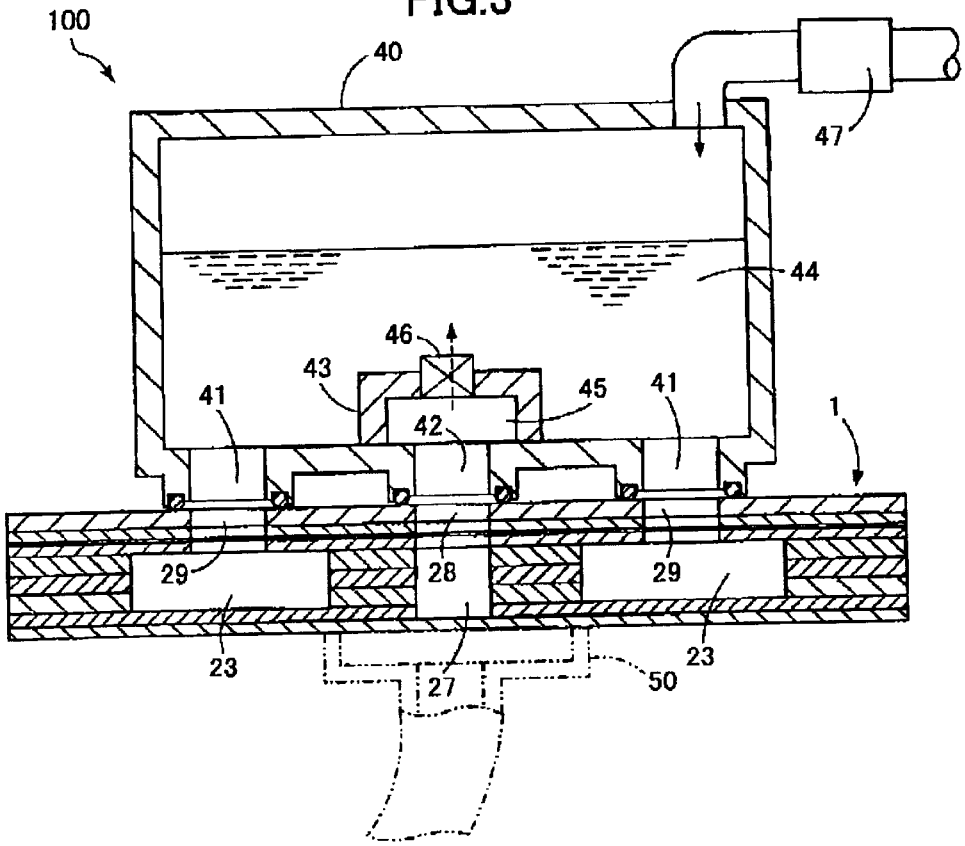
FIG. 3 is a cross-sectional view taken along line III—III of FIG. 1.

The common ink chambers 23, 23 are formed by openings in the fifth to ninth substrates 15 to 17. As shown in FIG. 1, the common ink chambers 23, 23 are elongated in the direction that the rows of pressure chambers 20 extend. As shown in FIG. 2, the common ink chambers 23, 23 are located below and substantially in parallel with corresponding rows of pressure chambers 20. As shown in FIG. 1, one end of each common ink chamber 23, 23 is in fluid communication with the circulation channel 27. As shown in FIG. 3, the other end of the common ink chambers 23, 23 are in fluid communication with openings 29, 29, respectively, which are opened in the upper surface of the cavity plate set 10.

Figure 4:
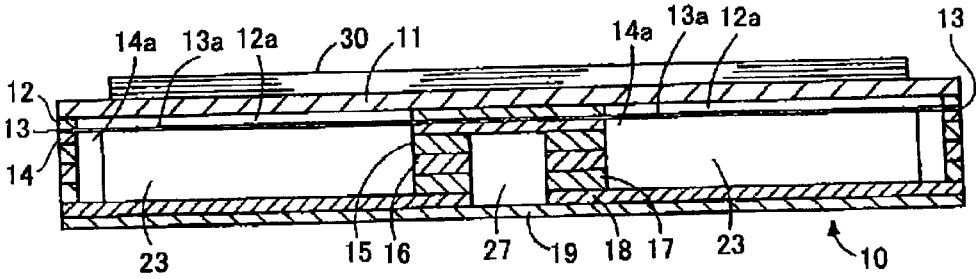
FIG. 4 is a cross-sectional view taken along line VI—VI of FIG. 1.

As shown in FIGS. 2 to 4, the circulation channel 27 is formed by openings in the substrates 15 to 18. The circulation channel 27 and the common ink chambers 23, 23 define an imaginary plane that is parallel with the imaginary plane defined by the pressure chambers 20. The circulation channel 27 is positioned between the two rows of through holes 22 and the two common ink chambers 23, 23. As best seen in FIG. 1, the circulation channel 27 extends in between the two common ink chambers 23, 23 in parallel with the lengthwise direction of common ink chambers 23, 23. One end of the circulation channel 27 is in fluid communication with the corresponding ends of the common ink chambers 23, 23. As shown in FIG. 3, the other end of the circulation channel 27 is in fluid communication with an opening 28 that is opened in the upper surface of the cavity plate set 10. As shown in FIG. 1, the three openings 28, 29, 29 of the cavity plate 10 are positioned on the same lengthwise end of the common ink chambers 23, 23 and circulation channel 27 and, as shown in FIG. 3, are aligned at the upper surface of the cavity plate 10.

Figure 5:
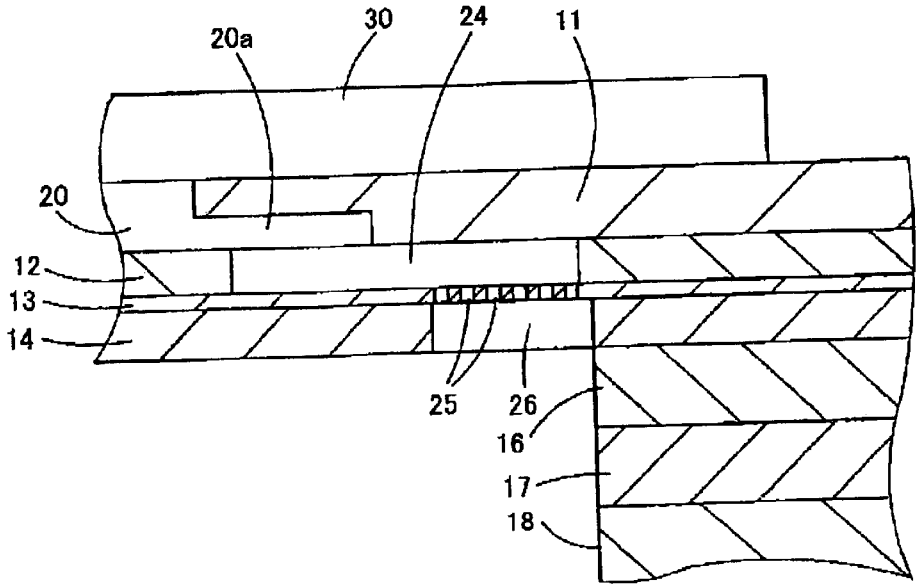
FIG. 5 is an expanded view showing a filter portion of the ink jet head.

Each pressure chamber 20 includes a restriction channel 20*a* at the end of the pressure chamber 20 that is opposite from the end in fluid communication with the through holes 22. Each restriction channel 20*a* has a smaller cross section than other portions of the corresponding pressure chamber 20. As best seen in FIG. 5, each restriction channel 20*a* is in fluid communication with a corresponding one of the common ink chambers 23, 23 through a through channel 24 of the second substrate 12, filter holes 25 of the third substrate 13, and a through hole 26 of the fourth substrate 14.

Figure 6:
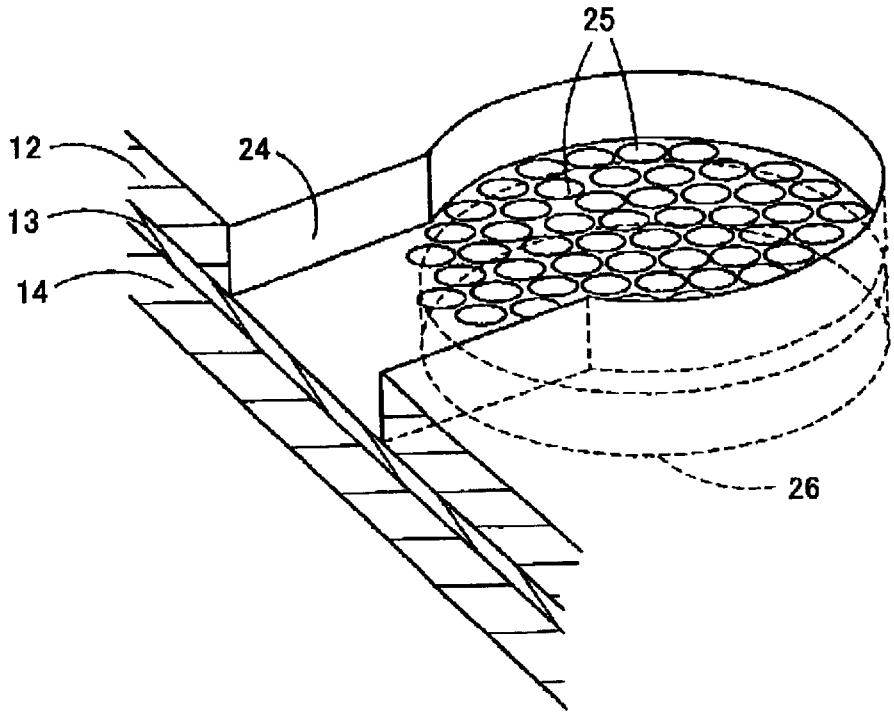
FIG. 6 is perspective view showing the filter portion of the ink jet head.

The third substrate 13 is a thin plate of resilient material electroformed to a thickness of about 5 to 20 $\mu$m. As shown in FIGS. 5 and 6, the third substrate 13 is formed with a plurality of filter holes 25 each having a diameter of 15 $\mu$m or less. The filter holes 25 are provided in clusters at positions where each through hole 24 confronts the corresponding through hole 26. Because each cluster of filter holes 25 is positioned along the ink flow from the common ink chambers 23, 23 to the pressure chambers 20, dust and other debris that entered into the ink jet head 1 during production of the ink jet head 1 will be less likely to flow from the common ink chambers 23, 23 into the pressure chambers 20 and accumulate in the channel from the pressure chambers 20 to the nozzle orifices 21. Also, dust and other debris that enters the ink jet head 1 when the ink tank 40 is mounted onto the ink jet head 1 can be prevented from flowing into the pressure chambers 20, so that clogs can be prevented in the channel from the pressure chambers 20 to the nozzle orifices 21. Because the third substrate 13 formed to a thickness of about 5 to 20 $\mu$m and the filter holes 25 each have a diameter of 15 $\mu$m or less, the third substrate 13 can be easily made. It should be noted that the third substrate 13 can also be formed with filter holes where it is exposed in the openings 29, 29 as shown in FIG. 3.

The configuration of the actuator unit 30 is shown in U.S. Pat. No. 5,402,159, the disclosure of which is hereby incorporated by reference. The actuator unit 30 includes piezoelectric ceramic layers and electrodes stacked in alternation, and is fixed to the upper surface of the cavity plate set 10. At least one of the electrodes that sandwich each piezoelectric ceramic layer includes portions that are located at positions corresponding to the pressure chambers 20 and that are formed with planer shapes substantially the same as the planer shape of the pressure chambers 20, but slightly smaller. To eject ink from one of the nozzle orifices 21, a voltage is applied between the electrodes that correspond to the pressure chamber 20 in fluid communication with the nozzle orifice 21. As a result, the piezoelectric ceramic layer sandwiched between the electrodes deforms and applies pressure to the ink in the corresponding pressure chamber 20. Ink is ejected from the corresponding-nozzle orifices 21 as a result.

As shown in FIG. 3, an ink jet printer 100 includes the ink jet head 1, an ink tank 40, a flow unit 47, and a cap 50. The ink tank 40 stored ink and serves as an ink supply source for the ink jet head 1. Two ink supply ports 41, 41 and a circulation port 42 are formed in the ink-jet-head side of the ink tank 40. The ink supply ports 41, 41 are in confrontation with the openings 29, 29 of the two common ink chambers 23, 23. The circulation port 42 is in confrontation with the opening 28 of the circulation channel 27. Because the three openings 28, 29, 29 of the cavity plate 10 are aligned on one side of the upper surface of the cavity plate 10, the ink supply ports 41, 41 and the circulation port 42 of the ink tank 40 can be easily connected to the openings 28, 29, 29 so that the ink tank 40 can be easily attached to and detached from the cavity plate 10.

The ink tank 40 includes a partition wall 43 that divides the ink holding space of the ink tank 40 into a first chamber 44 and a second chamber 45. The first chamber 44 is in fluid communication with the ink supply ports 41, 41 and the second chamber 45 is in fluid communication with the circulation port 42. The partition wall 43 includes a unidirectional flow mechanism 46 that enables ink to flow only from the second chamber 45 to the first chamber 44. The unidirectional flow mechanism 46 can be a unidirectional fluid valve, or can use two valves in the same manner as the device described in U.S. Pat. No. 6,152,559, the disclosure of which is hereby incorporated by reference.

The flow unit 47 is provided for applying pressure to the ink in the ink tank 40 in order to move ink in the ink tank 40 from the ink supply ports 41, 41 to the cavity plate 10. The flow unit 47 can be a positive-pressure mechanism such as an air flow unit or a compressor that increases the pressure in the first chamber 44 to push the ink out from the ink supply ports 41, 41 or a liquid pump disposed within the ink supply ports 41, 41.

The flow unit 47 does not operate during normal printing operations. Replenishment of ink during normal printing operations is induced by deformation of the actuator 30. That is, either before or after ink is ejected from the pressure chambers 20, deformation of the actuator 30 draws ink from the common ink chambers 23, 23 into the pressure chambers 20 and ink from the ink tank 40 into the common ink chambers 23, 23 through the ink supply ports 41, 41.

The flow unit 47 is driven to remove bubbles and debris that has accumulated in the common ink chambers 23, 23. When the flow unit 47 is driven, the ink in the ink tank 40 flows through the ink supply ports 41, 41 to the common ink chambers 23, 23, then from the common ink chambers 23, 23 to the circulation channel 27, and then back to the ink tank 40 through the circulation port 42 and the unidirectional flow mechanism 46. At this time, the ink flows at a higher speed than during normal printing. Any bubbles and debris in the common ink chambers 23, 23 is drawn by this fast flow of ink and is collected in the ink tank 40.

It is desirable that at this time the nozzle orifices 21 of the cavity plate 10 be covered by the cap 50. Further, is desirable that a suction operation be simultaneously performed using the cap 50 and a suction unit (not shown) of the ink jet printer 100 connected to the cap 50. In accordance with need, the cap 50 is operated to cover the ink jet head 1 and the suction pump is operated to suck ink out from the pressure chambers 20, the common ink chambers 23, 23, and the nozzle orifices 21 while performing a circulation operation. Using the ink circulation operation and the ink suction operation, air bubbles and ink that has started to dry can be removed so that the ink ejection properties of the ink jet head 1 can be maintained or recovered. There is no need to discharge a great amount of ink from the common ink chambers 23, 23 during the suction operation, so ink will not be wasted.

As shown in FIGS. 1 and 4, the common ink chambers 23, 23 are formed with broad portions 23*a* at ends of the common ink chambers 23, 23 that are connected to the circulation channel 27, that is, at the lengthwise ends of the common ink chambers 23, 23 that are opposite from the openings 29, 29. With this configuration, the broad portions 23*a* are located at regions of the common ink chambers 23, 23 that are separated from where the common ink chambers 23, 23 are in fluid communication with outer ends of the pressure chambers 20. As shown in FIG. 4, the broad portions 23*a* are formed by openings 14*a* in the fourth substrate 14. The openings 14*a* increase the width of the common ink chambers 23, 23 and are located at edges of the common ink chambers 23, 23 that are opposite from edges that confront the circulation channel 27.

As shown in FIG. 4, the third substrate 13 includes an exposed section 13*a*, which forms a flexible wall of each of the common ink chambers 23, 23. The exposed section 13*a* has a weaker mechanical stiffness than other portions of the common ink chambers 23, 23, and so is resiliently deformable, because its lower surface is exposed in the broad portions 23*a* and because spaces 12*a* are formed above its upper surface. That is, the substrate 12 is formed with spaces 12*a* at positions that correspond to the broad portions 23*a*. The exposed section 13*a* is the section of the substrate 13 that corresponds to the spaces 12*a* and 14*a*.

When ink is ejected from many of the pressure chambers 20 simultaneously, the resultant pressure fluctuations propagate from the pressure chambers 20 to the common ink chambers 23, 23. Also, because a relatively large amount of ink was ejected, ink flows at a relatively high speed from the openings 29, 29, into the common ink chambers 23, 23, and toward the broad portions 23*a*. The pressure waves propagate into the broad portions 23*a* in association with the fast ink flow. The pressure fluctuations are dampened by the broadened cross-sectional area of the broad portions 23*a*, so that pressure waves associated with ink ejection that propagate on the flow of ink in the common ink chambers 23, 23 are weakened at the portion with a broad cross-sectional area. Also, because the exposed section 13*a* has a weaker mechanical stiffness than other portions of the common ink chambers 23, 23, it can resiliently deform with and absorb pressure fluctuations in the common ink chambers 23, 23 that occur when ink is ejected, and prevent cross talk that can be caused by the pressure fluctuations. With this configuration, cross talk can be prevented and pressure fluctuations can be eliminated before subsequent ink ejections. Because each cluster of filter holes 25 is interposed between the pressure chambers 20 and the common ink chambers 23, 23, pressure waves that propagate from the pressure chambers 20 toward the common ink chambers 23, 23 are dampened by resistance at the filter holes 25. This further increases prevention of cross talk.

Because common ink chambers 23, 23 are formed broader at edges opposite from the circulation channel 27, the broad portions 23*a* can be provided without restricting the size and positional arrangement of the circulation channel 27. The ink jet head 1 can be made more compact.

Because the pressure chambers 20 are formed in one substrate and the common ink chambers 23, 23 and the circulation channel 27 are formed in another set of substrates, and because these substrates are stacked together and oriented substantially parallel to each other, the common ink chambers 20 and the circulation channel 27 are easily formed and can be easily combined with the plurality of pressure chambers 20.

Because the circulation channel 27 is disposed closer to the end of the pressure chambers 20 that corresponds to the nozzle orifices 21 than to the end that corresponds to the through holes 26, the pressure chambers 20, the common ink chambers 23, 23, and the circulation path 27 can be arranged in a compact configuration.

Because the circulation channel 27 is interposed between the common ink chambers 23, 23 and shared by both of the common ink chambers 23, 23, the pressure chambers 20, the common ink chambers 23, 23, and the circulation path 27 can be arranged in a compact configuration.

Although both the broad portions 23*a* and the exposed section 13*a* are provided in the embodiment, only one or the other need be provided. Because the broad portions 23*a* of the common ink chambers 23, 23 encompass a large space, the substrate walls that define it will have lower mechanical stiffness, so that pressure waves that propagate to the broad portions 23*a* can be effectively weakened. Therefore, the exposed section 13*a* need not be provided. This configuration has the added benefit of using the configuration for circulating ink to effectively absorb pressure fluctuations. However, it is desirable that the portion of the cavity plate 10 that defines the broad portions 23*a* be thin like the substrate 13. Also, mechanical stiffness where the exposed section 13*a* operates to reduce pressure fluctuations is weakened even more, so that pressure fluctuations can be effectively absorbed.

The configuration of the cavity plate set 10 can be modified by providing only the fourth substrate 14 at the upper part of the broad portions 23*a*, that is, without providing the substrates uppermost substrate 11 to 13, and also providing only the lowermost substrate 19 at the lower portion of the broad portions 23*a*. In this case, the substrates 14 and 19 are formed resiliently deformable. Also, the substrates 14 and 19 will have weaker mechanical stiffness than other portions of the cavity plate 10 because it encompasses a broad space. Therefore, this configuration will easily absorb pressure fluctuations.

As described above, the openings 29, 29 and the region with weak mechanical stiffness, which is formed from the exposed section 13*a* and the broad portion 23*a* in the embodiment, are disposed on opposite sides of the common ink chambers 23, 23 with the pressure chambers 20 interposed therebetween. As a result, pressure waves associated with ink ejection that propagate on the flow of ink in the common ink chambers 23, 23 can be effectively absorbed.

It should be noted that if the common ink chambers 23, 23 were formed with a weaker mechanical stiffness at regions that correspond to the pressure chambers 20, then the mechanical stiffness of the cavity plate 10 will be different at the center and the ends of the rows of pressure chambers 20. This would cause variations in pressure generated in the pressure chambers 20 and result in non-uniformity in ink ejection characteristics. However, because the broad portions 23*a* are formed in regions that are separated from where the outer ends of the pressure chambers 20 are in fluid communication with the common ink chambers 23, 23, the mechanical stiffness of the cavity plate 10 is uniform with respect to all of the pressure chambers 20, so that ink ejection characteristics of the pressure chambers 20 are uniform.

While the invention has been described in detail with reference to specific embodiments thereof, it would be apparent to those skilled in the art that various changes and modifications may be made therein without departing from the spirit of the invention, the scope of which is defined by the attached claims.

For example, the uppermost substrate 11 could be formed with more than two rows of pressure chambers 20.

Also, other types of actuators could be used instead of the actuator unit 30. Any mechanism that can apply pressure for ejecting ink can be used. For example, a mechanism that generates force by static electricity or by locally boiling ink can be used.

What is claimed is:

1. An ink jet head comprising:

a pressure chamber portion formed with a row of pressure chambers aligned in a pressure chamber row direction, each pressure chamber having a nozzle end and a common-ink-chamber end at opposite ends thereof, the nozzle end of each pressure chamber being in fluid communication with a corresponding nozzle orifice;

a common ink chamber portion formed with a common ink chamber elongated in the pressure chamber row direction, the common ink chamber including a pressure-chamber region and a weak-mechanical-stiffness region that are separated from each other, the pressure-chamber region being in fluid communication with the common-ink-chamber end of each pressure chamber so that ink is supplied from the common ink chamber to the pressure chambers, the weak-mechanical-stiffness region having a weaker mechanical stiffness than mechanical stiffness at the pressure-chamber region.

2. An ink jet head as claimed in claim 1, wherein the common ink chamber further includes an ink-supply-connection opening at one lengthwise end thereof for bringing the common ink chamber into fluid communication with an external ink supply source, the ink-supply-connection opening and the weak-mechanical-stiffness region being disposed on opposite sides of the common ink chamber with the pressure-chamber region interposed therebetween.

3. An ink jet head as claimed in claim 2, further comprising a circulation channel portion formed with a circulation channel that extends substantially parallel with the common ink channel, the circulation channel including an ink-supply-connection opening at one lengthwise end thereof for bringing the circulation channel into fluid communication with the external ink supply, the circulation channel and the common ink chamber being in fluid communication with each other at a same lengthwise end opposite from the lengthwise end formed with the ink-supply-connection openings of the circulation channel and the common ink chamber, the weak-mechanical-stiffness region of the common ink chamber also being located at the same lengthwise end.

4. An ink jet head as claimed in claim 1, wherein the weak-mechanical-stiffness region of the common ink chamber has a broader width than the pressure-chamber region of the common ink chamber.

5. An ink jet head as claimed in claim 1, wherein the common ink chamber includes at least one wall at the weak-mechanical-stiffness region with a weaker mechanical stiffness than walls at the pressure-chamber region.

6. An ink jet head as claimed in claim 5, wherein:

the pressure chamber portion includes a first substrate formed with the pressure chambers aligned with an imaginary plane; and the common ink chamber portion includes a second substrate formed with the common ink chamber aligned with an imaginary plane that is parallel with the imaginary plane defined by the pressure chambers; further comprising:

a resilient third substrate interposed between the first substrate and the second substrate so that the first substrate, the second substrate, and the third substrate are stacked together in a laminated body, the third substrate including the at least one wall surface at the weak-mechanical-stiffness region of the common ink chamber, the at least one wall surface of the third substrate having a first-substrate facing side and a second-substrate facing side at opposite surfaces thereof, the second-substrate facing side being exposed in the common ink chamber and the first-substrate facing side being exposed in an open space so that the flexible region is deformable in accordance with pressure fluctuations in the common ink chamber.

7. An ink jet head comprising:

a pressure chamber portion formed with a row of pressure chambers aligned in a pressure chamber row direction, each pressure chamber having a nozzle end and a common-ink-chamber end at opposite ends thereof, the nozzle end of each pressure chamber being in fluid communication with a corresponding nozzle orifice; and a common ink chamber portion formed with a common ink chamber elongated in the pressure chamber row direction, the common ink chamber including:

a pressure-chamber region where the common ink chamber is in fluid communication with the common-ink-chamber end of each pressure chamber so that ink is supplied from the common ink chamber to the pressure chambers;

an ink-supply-connection opening in fluid communication with an external ink supply source; and a broad-width region located at lengthwise end of the common ink chamber opposite to the ink-supply-connection opening, the broad-width region being separated from the pressure-chamber region and having a broader width than other regions of the common ink chamber.

8. An ink jet head as claimed in claim 7, further comprising a circulation channel portion formed with a circulation channel that extends substantially parallel with the common ink channel, the circulation channel including an ink-supply-connection opening at one lengthwise end thereof for bringing the circulation channel into fluid communication with the external ink supply, the circulation channel and the common ink chamber being in fluid communication with each other at a same lengthwise end opposite from the lengthwise end formed with the ink-supply-connection openings of the circulation channel and the common ink chamber, the broad-width region of the common ink chamber also being located at the same lengthwise end.

9. An ink jet recording device comprising:

an ink jet head including:

a pressure chamber portion formed with a row of pressure chambers aligned in a pressure chamber row direction, each pressure chamber having a nozzle end and a common-ink-chamber end at opposite ends thereof, the nozzle end of each pressure chamber being in fluid communication with a corresponding nozzle orifice;

a common ink chamber portion formed with a common ink chamber elongated in the pressure chamber row direction, the common ink chamber portion including a pressure-chamber region, a weak-mechanical-stiffness region, and an ink-supply-connection opening, the pressure-chamber region being in fluid communication with the common-ink-chamber end of each pressure chamber so that ink is supplied from the common ink chamber to the pressure chambers, the weak-mechanical-stiffness region being separated from the pressure-chamber region and having a weaker mechanical stiffness than mechanical stiffness at the pressure-chamber region, the ink-supply-connection opening bringing the common ink chamber into fluid communication with an external ink supply source, the ink-supply-connection opening and the weak-mechanical-stiffness region being disposed on lengthwise opposite sides of the common ink chamber with the pressure-chamber region interposed therebetween; and a circulation channel portion formed with a circulation channel that extends substantially parallel with the common ink channel, the circulation channel including an ink-supply-connection opening at one lengthwise end thereof for bringing the circulation channel into fluid communication with the external ink supply, the circulation channel and the common ink chamber being in fluid communication with each other at a same lengthwise end opposite from the lengthwise end formed with the ink-supply-connection openings of the circulation channel and the common ink chamber, the weak-mechanical-stiffness region of the common ink chamber also being located at the same lengthwise end; and a circulation unit in fluid communication with the ink-supply-connection opening of the common ink chamber and with the ink-supply-connection opening of the circulation channel, the circulation unit forcing ink from the ink supply source into one of the ink-supply-connection openings and returning ink to the ink supply source from the other one of the ink-supply-connection openings.

10. An ink jet recording device comprising:

an ink jet head including:

a pressure chamber portion formed with a row of pressure chambers aligned in a pressure chamber row direction, each pressure chamber having a nozzle end and a common-ink-chamber end at opposite ends thereof, the nozzle end of each pressure chamber being in fluid communication with a corresponding nozzle orifice;

a common ink chamber portion formed with a common ink chamber elongated in the pressure chamber row direction, the common ink chamber including:

a pressure-chamber region where the common ink chamber is in fluid communication with the common-ink-chamber end of each pressure chamber so that ink is supplied from the common ink chamber to the pressure chambers;

an ink-supply-connection opening in fluid communication with an external ink supply source; and a broad-width region located at an opposite lengthwise end of the common ink chamber from the ink-supply-connection opening, the broad-width region being separated from the pressure-chamber region and having a broader width than other regions of the common ink chamber; and a circulation channel portion formed with a circulation channel that extends substantially parallel with the common ink channel, the circulation channel including an ink-supply-connection opening at one lengthwise end thereof for bringing the circulation channel into fluid communication with the external ink supply, the circulation channel and the common ink chamber being in fluid communication with each other at a same lengthwise end opposite from the lengthwise end formed with the ink-supply-connection openings of the circulation channel and the common ink chamber, the broad-width region of the common ink chamber also being located at the same lengthwise end; and a circulation unit in fluid communication with the ink-supply-connection opening of the common ink chamber and with the ink-supply-connection opening of the circulation channel, the circulation unit forcing ink from the ink supply source into one of the ink-supply-connection openings and returning ink to the ink supply source from the other one of the ink-supply-connection openings.

11. An ink jet head comprising:

a pressure chamber portion formed with a row of pressure chambers aligned in a pressure chamber row direction, each pressure chamber having a nozzle end and a common-ink-chamber end at opposite ends thereof, the nozzle end of each pressure chamber being in fluid communication with a corresponding nozzle orifice;

a common ink chamber portion formed with a common ink chamber elongated in the pressure chamber row direction, the common ink chamber being in fluid communication with the common-ink-chamber end of each pressure chamber so that ink is supplied from the common ink chamber to the pressure chambers, the common ink chamber including an ink-supply-connection opening at one lengthwise end thereof to enable connection to an external ink supply; and a circulation channel portion formed with a circulation channel that extends substantially parallel with the common ink channel, the circulation channel including an ink-supply-connection opening at one lengthwise end thereof to enable connection to the external ink supply, the circulation channel and the common ink chamber being in fluid communication with each other at a lengthwise end opposite from the lengthwise end formed with the ink-supply-connection openings of the circulation channel and the common ink chamber.

12. An ink jet head as claimed in claim 11, wherein the pressure chamber portion includes a first substrate and the common ink chamber portion includes a second substrate, the first substrate and the second substrate being stacked together in a laminated body, the first substrate being formed with the pressure chambers aligned with an imaginary plane, the second substrate being formed with the common ink chamber aligned with an imaginary plane that is parallel with the imaginary plane defined by the pressure chambers.

13. An ink jet head as claimed in claim 11, wherein the circulation channel is disposed nearer the nozzle end of each pressure chamber than the common-ink-chamber end of each pressure chamber.

14. An ink jet head as claimed in claim 11, wherein the pressure chambers are disposed in a plurality of rows and a common ink chamber is provided separately for each row of pressure chambers, the circulation channel being disposed between the rows of pressure chambers and being shared by the common ink chambers.

15. An ink jet recording device comprising:

an ink jet head including:

a pressure chamber portion formed with a row of pressure chambers aligned in a pressure chamber row direction, each pressure chamber having a nozzle end and a common-ink-chamber end at opposite ends thereof, the nozzle end of each pressure chamber being in fluid communication with a corresponding nozzle orifice;

a common ink chamber portion formed with a common ink chamber elongated in the pressure chamber row direction, the common ink chamber being in fluid communication with the common-ink-chamber end of each pressure chamber so that ink is supplied from the common ink chamber to the pressure chambers, the common ink chamber including an ink-supply-connection opening at one lengthwise end thereof to enable connection to an external ink supply; and a circulation channel portion formed with a circulation channel that extends substantially parallel with the common ink channel, the circulation channel including an ink-supply-connection opening at one lengthwise end thereof to enable connection to an external ink supply, the circulation channel and the common ink chamber being in fluid communication with each other at a lengthwise end opposite from the lengthwise end formed with the ink-supply-connection openings of the circulation channel and the common ink chamber; and a circulation unit in fluid communication with the ink-supply-connection opening of the common ink chamber and with the ink-supply-connection opening of the circulation channel, the circulation unit forcing ink from the ink supply source into one of the ink-supply-connection openings and returning ink to the ink supply source from the other one of the ink-supply-connection openings.

16. An ink jet recording device as claimed in claim 15, wherein the ink supply source is an ink tank including a circulation port and an ink supply port in confrontation with corresponding ones of the ink-supply-connection openings.

17. An ink jet head comprising:

a first substrate, a second substrate, and a third substrate stacked on top of each other, wherein:

the first substrate is formed with a plurality of pressure chambers aligned in a pressure chamber row direction, each pressure chamber having a nozzle end and a common-ink-chamber end at opposite ends thereof, the nozzle end of each pressure chamber being in fluid communication with a corresponding nozzle orifice;

the second substrate is formed with a common ink chamber elongated in the pressure chamber row direction, the common ink chamber being in fluid communication with the common-ink-chamber end of each pressure chamber so that ink is supplied from the common ink chamber to the pressure chambers; and the third substrate is interposed between the first substrate and the second substrate, the third substrate including a plurality of filter, each located between the common ink chamber and the common-ink-chamber end of a corresponding one of the pressure chambers, each filter having a plurality of filter holes.

18. An ink jet head as claimed in claim 17, wherein the third substrate includes a flexible region that extends parallel with the common ink chamber, the flexible region having a first-substrate facing side and a second-substrate facing side at opposite surfaces thereof, the second-substrate facing side being exposed in the common ink chamber and the first-substrate facing side being exposed in an open space so that the flexible region is deformable in accordance with pressure fluctuations in the common ink chamber.

19. An ink jet head as claimed in claim 17, wherein the third substrate is formed to a thickness of between 5 $\mu$m and 20 $\mu$m and the filter holes are each formed with a diameter of substantially 15 $\mu$m.

20. An ink jet head as claimed in claim 17, wherein the pressure chambers are aligned with an imaginary plane and the common ink chamber is aligned with an imaginary plane that is parallel with the imaginary plane of the pressure chambers.

21. An ink jet head as claimed in claim 17, further comprising a fourth substrate interposed between the first substrate and the third substrate, the fourth substrate including a plurality of through holes and an opening, wherein the common ink chamber is in fluid communication with the common-ink-chamber end of each pressure chamber through a corresponding one of the filters and a corresponding one of the through holes, and the opening overlies the third substrate and overlaps a part of the common ink chamber.

* * * * *